United States Patent [19]

Goldfarb et al.

[11] 4,017,078

[45] Apr. 12, 1977

[54] AIR TABLE HANDBALL GAME APPARATUS

[76] Inventors: Adolph E. Goldfarb, 4614 Monarca Drive, Tarzana, Calif. 91356; Erwin Benkoe, 17965 Medley Drive, Encino, Calif. 91316

[22] Filed: Dec. 15, 1975

[21] Appl. No.: 640,837

[52] U.S. Cl. ..... 273/126 A

[51] Int. Cl.[2] ..... A63F 3/00

[58] Field of Search ..... 273/126 R, 126 A, 125 A, 273/124 R, 124 A, 123 R, 123 A, 119 R, 119 A, 129 R, 122 A, 118 R, 118 A, 118 D, 39, 2

[56] References Cited

UNITED STATES PATENTS

| | | | |
|---|---|---|---|
| 371,340 | 10/1887 | McCormick | 273/124 R |
| 590,785 | 9/1897 | Barnett | 273/126 R |
| 733,850 | 7/1903 | Koch et al. | 273/124 R |
| 1,395,634 | 11/1921 | Fegleborg | 273/124 R |
| 1,574,653 | 2/1926 | Holm | 273/124 R |
| 1,599,188 | 9/1926 | Seede | 273/119 R |
| 1,945,798 | 2/1934 | Barry | 273/121 R |
| 3,219,349 | 11/1965 | Smith | 273/126 R |
| 3,315,965 | 4/1967 | Weiderspan | 273/125 R |
| 3,773,325 | 11/1973 | Crossman et al. | 273/126 A |
| 3,907,294 | 9/1975 | Breslow | 273/39 |

FOREIGN PATENTS OR APPLICATIONS

| | | | |
|---|---|---|---|
| 240,946 | 1/1960 | Australia | 273/126 R |
| 416,583 | 8/1910 | France | 273/124 R |
| 218,906 | 1/1942 | Switzerland | 273/124 R |

*Primary Examiner*—Anton O. Oechsle
*Assistant Examiner*—T. Brown
*Attorney, Agent, or Firm*—Robert M. Ashen; Robert J. Schaap

[57] ABSTRACT

A fast action air table handball game having a perforated, upwardly directed inclined playing surface. Disposed beneath the playing surface is enclosing structure which creates an air chamber beneath the playing surface. A pump or blower is provided for pumping air into the chamber under pressure so that air is emitted through apertures in the playing surface to thereby form an air flow cushion to aid in the movement over the surface of a disc-shaped play piece. The playing surface has a rear player's end and an opposite forward rebound end. The player's end is divided by an upstanding dividing structure into side-by-side player goal areas. The playing surface is surrounded except at the goal areas with upstanding peripheral play piece rebound surfaces piece on the playing surface, and off piece rebounds during play. The dividing structure provides added rebound surfaces. Each of the opponent players is provided with a hand-held striker for engaging the play piece, to propel it over the surface and against the rebound surfaces, particularly those at the opposite forward rebound end, to thereby cause it to rebound back toward the opponent player's goal area. Each player also uses his striker to defend his own goal area. The playing surface is inclined downwardly from the rebound end toward the players' end piece and to prevent it from coming to rest and thereby stopping the action play. Angle bumpers are also provided at various corners of the playing surface to form added rebound surfaces that provide added travel paths for the play piece and prevent it from becoming lodged in a corner and rebound it out into intermediate, more accessible portions of the playing surface and clear of rebound surfaces. A score detector may also be associated with each opponent player's goal area so that when the play piece is introduced into the goal area of the opponent player, the other player achieves a score.

10 Claims, 14 Drawing Figures

AIR TABLE HANDBALL GAME APPARATUS

BACKGROUND OF THE INVENTION

1. Field of the Invention

This invention relates in general to certain new and useful improvements in game apparatus, and, more particularly, a simulated handball game apparatus which utilizes an air table having a playing piece movably supported on an air cushion.

2. Description of Prior Art

There are commercially available game apparatus which utilize an air table on which a playing piece is supported during movement on the playing surface of the air table by an air cushion. Generally, these forms of game apparatus create an air plenum chamber beneath the playing surface with an air pump or similar means to create under pressure in the chamber. Apertures formed in the playing surface permit the ejection of air through these apertures to thereby create the air cushion and thereby support the playing piece on the air cushion during movement along the playing surface. U.S. Pat. Nos. 3,722,888 to Ducharme and 3,887,187 to Crossman, et al. represent several embodiments of an air cushion game which is indicative of the form of air game commercially available. However, such table games have generally been large in size, with the playing surface oftentimes approximating 4 feet by 8 feet because the goals are located at opposite ends of the table.

There are also existing games where a playing piece is movable over a relatively horizontally disposed non-air cushion playing surface and rebounds against a rear wall. For example, the U.S. Pat. No. 3,174,752, dated Mar. 23, 1965, to T. Plentis discloses a non-air cushion shuffle board game device where a playing piece is slid over a surface to strike a forwardly presented rebound wall, from which it rebounds rearwardly and comes to rest in a scoring lane. At least portions of the lanes do not have rebound walls, but rather are surrounded by depressed areas into which the play piece will fall if it leaves the lanes. Further, this game does not utilize striker members to continuously hit the play piece back and forth between theplayers.

There is also a commercially available competitive rebound game shown in U.S. Pat. No. 3,907,294 to Breslow which employs a non-air cushion inclined playing surface and a rollable playing piece in the form of a ball. The surface has a rear wall against which the ball is rebounded by the players using a pair of striker members. Since this game uses a rollable playing piece, it clearly does not teach or suggest the use of an air cushion table to facilitate the movement of such a play piece.

It can also be observed that these forms of air table games are limited by their construction to simulate the play of only certain games or sports such as hockey, soccer, etc. For example, there is no known air table game which is capable of permitting the playing of a simulated form of handball wherein two opposing players are located at the same end of the air table game and attempt to rebound a playing piece, representative of a handball, off walls which extend along the opposite end and sides of the table so as to cause the playing piece to enter the opponent's goal area. Moreover, the frame which provides an enclosed area for the playing piece in these prior art devices is also not properly designed to provide a proper movement of the playing piece which is representative of the actual fast and virtually continuous movement of the ball in a sport such as handball. In particular, the playing element would at times slow or stop the play action. As examples, the playing element might come to a stop or be moving slowly at a point not readily accessible to either player, the element might become lodged in a corner of the table, or the element might move in a path so close to a side wall of the table that it is very difficult to strike (at least in a direction other than to cause it to continue to move along such side wall). With reference to the last mentioned problem, the playing element would tend to travel up and back between opposed walls or rebound surfaces, and if such travel path was close to a wall or surface extending between the opposed surfaces it was extremely difficult to interrupt that back and forth movement. While such back and forth movement was fast, it represented a slowdown or lull in the play action of the device.

OBJECTS OF THE INVENTION

It is, therefore, a primary object of the present invention to provide an air table handball game which is provided with a playing surface and rebound walls to create a movement of a playing piece, representative of a handball, and which simulates the fast and generally continuous movement of a handball in a handball court.

It is a further object of the present invention to provide an air table game of the type stated having a single player end at which the goal sectiona are located side-by-side respect to one another. It is another object of the present invention to provide an air table game of the type stated which requires a minimum of space not requiring aisle or access space at its sides so that it can be placed in a corner or next to other game structures or the like.

It is another object of the present invention to provide an air table game of the type stated which can be constructed at a relatively low unit cost and which can be designed in a large number of sizes and shapes to fulfill a large number of commercial requirements from a cost and size standpoint.

It is an additional object of the present invention to provide an air table game of the type stated which is highly reliable in its operation and relatively rigid in its construction to withstand the abuse to which it may be subjected, especially by children.

With the above and other objects in view, our invention resides in the novel features of form, construction, arrangement and combination of parts presently described and pointed out in the claims.

SUMMARY OF THE DISCLOSURE

The present invention relates to an air table game which is designed to represent a simulated handball game capable of being played by two opponent players. In this case, the air table game of the present invention includes a supporting frame carrying a playing plate having an upper playing surface thereon. The frame is provided with upstanding walls which have interior surfaces to create rebound surfaces for a playing piece.

Secured beneath the playing plate is a plenum forming member. The plenum forming member is connected to a pump or similar means for generating air under pressure within the air plenum chamber beneath the playing plate. Apertures in the playing plate permit the escapement of air therethrough in order to create an air cushion on the upper surface of this plate and on the playing surface. In this way, a playing piece, which is representative of a handball, is moved along the playing surface with reduced frictional effects compared to other forms of table games.

The table game apparatus of the present invention is uniquely designed to provide a front rebound surface at the front rebound end of the table, side rebound surfaces, and a player end opposite the front rebound surfaces having an upstanding divider which provides additional rebound surfaces and separates the player end into a pair of side-by-side player sections. Each of the player sections are provided with respective goal areas. The upper playing surface is inclined downwardly toward the player end so that the play piece will move more quickly toward a goal after it rebounds from the rebound end, and to prevent it from getting hung-up, i.e. stopped or virtually stopped, at a location remote from the players. Also, angled bumpers are provided at various corners where rebound surfaces join at generally right angles to provide angled corner rebound surfaces. The bumpers prevent the play piece getting lodged in a corner. They also prevent the play piece from traveling back and forth between a pair of opposed walls while hugging an adjacent wall. They further add variety to the playing piece movement and tend to keep it in the open, more playable, intermediate portions of the playing surface.

Each of the players of the handball game are provided with striker means in order to engage the playing piece. Thus, when one player strikes the playing piece to cause it to rebound from the side wall or the front wall formed by the frame, this player attempts to create a movement of the playing piece into the opponent's goal area. The opponent attempts to block the movement of the playing piece with his own striker means. If, however, the opponent player fails to prevent the movement of the playing piece into his goal area, the original player who struck the playing piece creates a score.

Th playing section of each of the players is provided with the aforementioned goal area in which to receive the playing piece. In this case, the goal area could be defined by a recess in which the playing piece moves, if not blocked by the opponent player. In an alternate embodiment of the present invention, the goal detecting means could be designed in the form of a switch mechanism which is contacted by the playing piece and which closes a circuit when so contacted in order to energize a light or otherwise actuate other forms of score depicting means.

Thus, the present invention represents an improvement in table game apparatus of the type which utilizes an air cushion over a playing surface to permit movement of a playing piece between opposed goals, and which game apparatus includes a peripheral wall confining the movement of the playing piece which is usually moved by a pair of hand-held strikers. The strikers are each used by one the players positioned at opposite ends of the table at one of the goals. In the present invention, both of the goals are located at the same end of the table, which is opposite a front rebound wall. Moreover, in the case of the present invention, the goal areas are separated and added rebound surfaces are provided by a physical divider means which projects upwardly from the playing surface and extends toward the front rebound wall.

A unique aspect of the present invention is that the inclined air cushion playing surface, together with rebound surfaces, combine to create fast and generally continuous movement of the playing piece representative of the fast and essentially continuous play action movement of the handball in a real handball game.

BRIEF DESCRIPTION OF THE DRAWINGS

Figure 1:
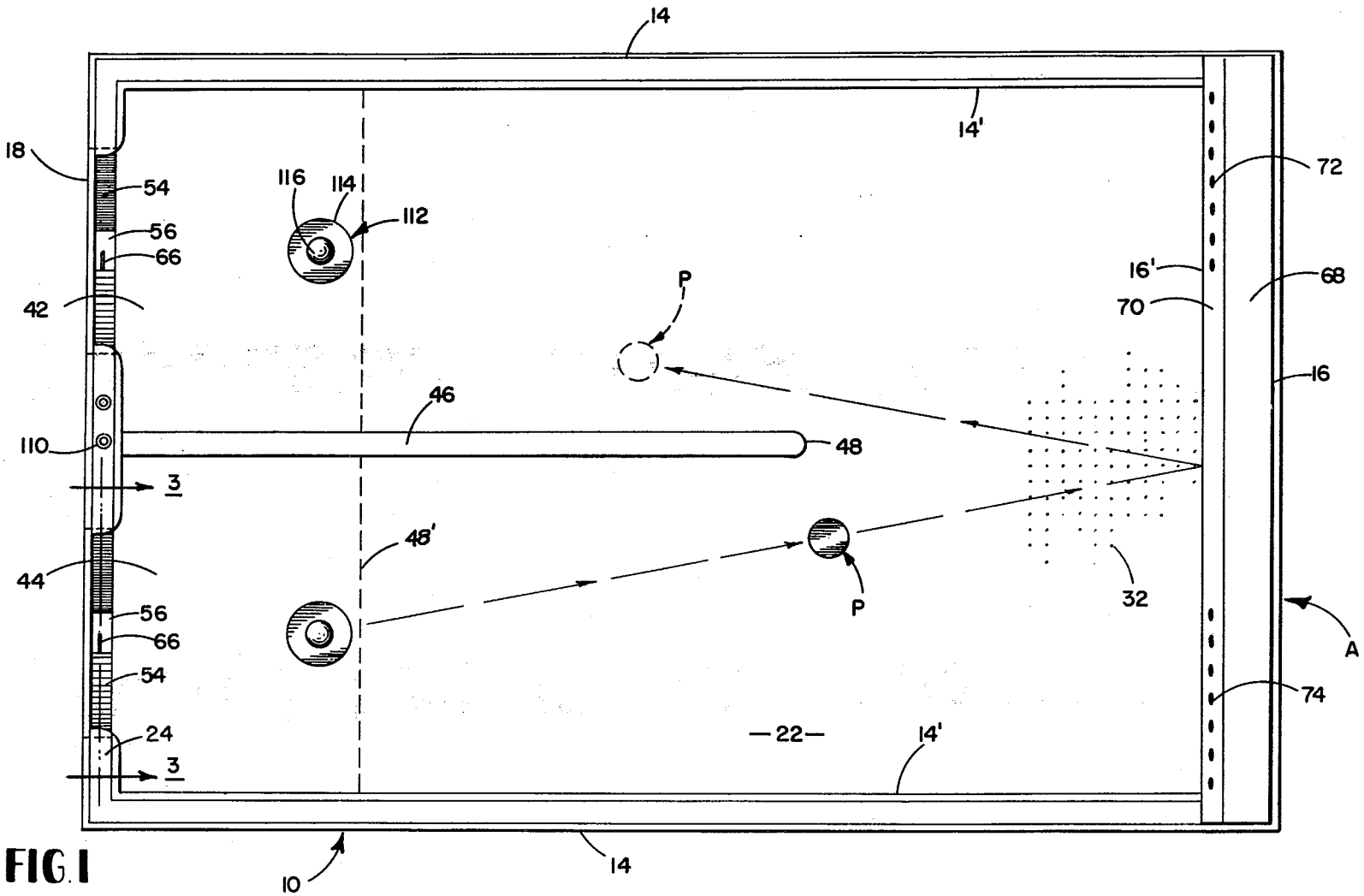
Figure 2:
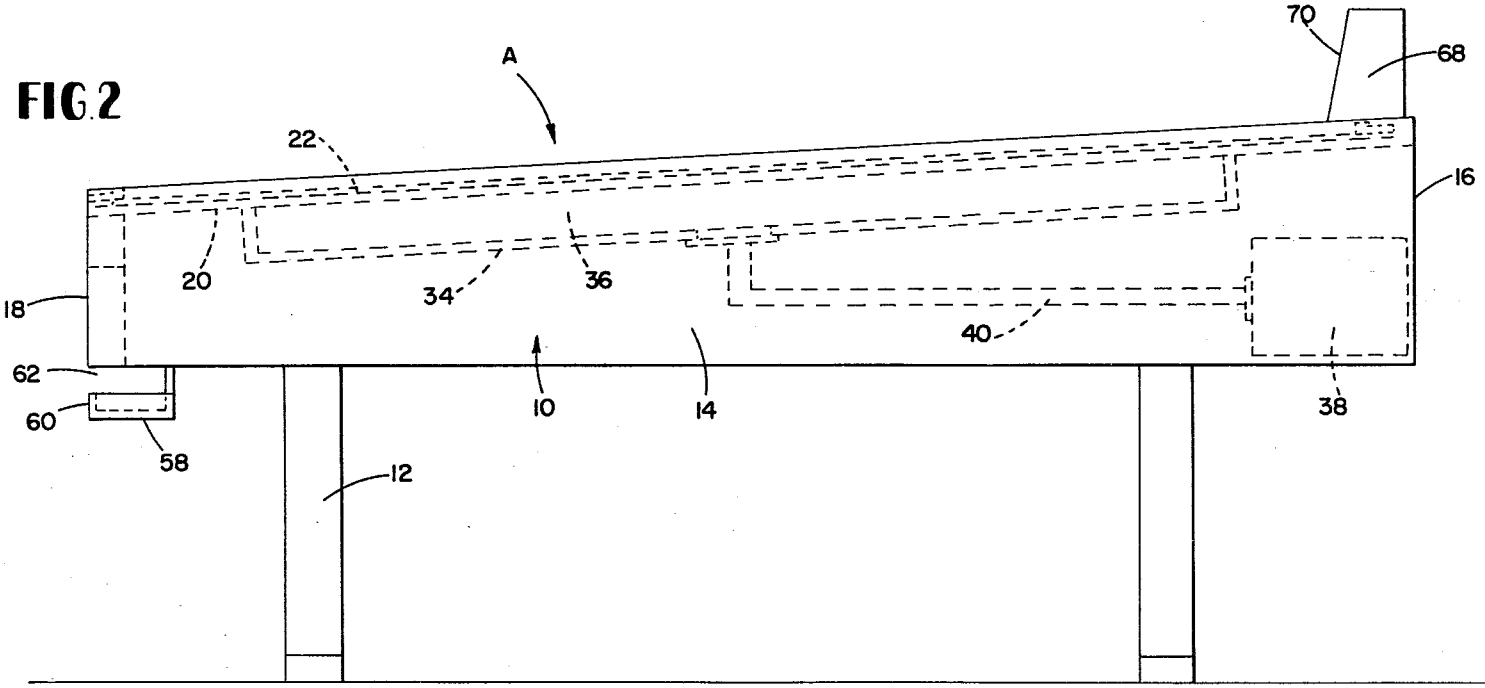
Figure 10:
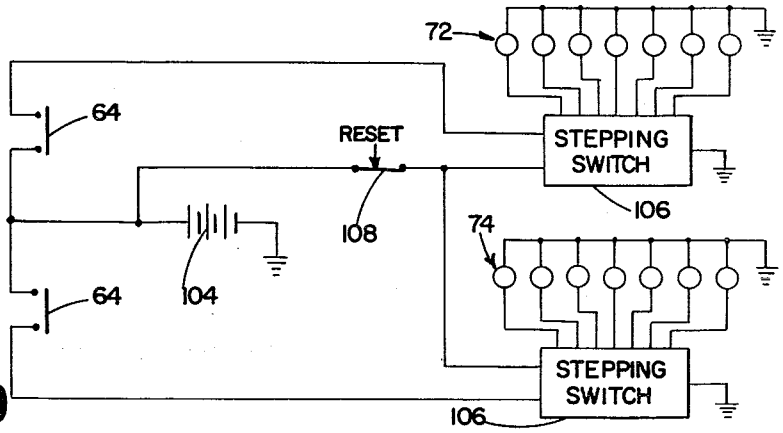
Figure 3:
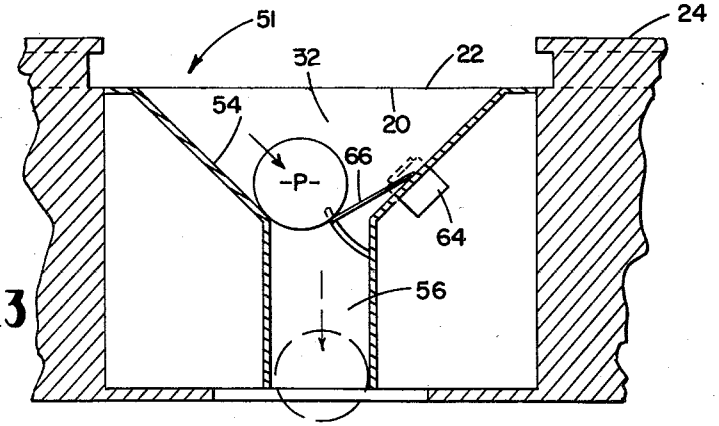
Figure 6:
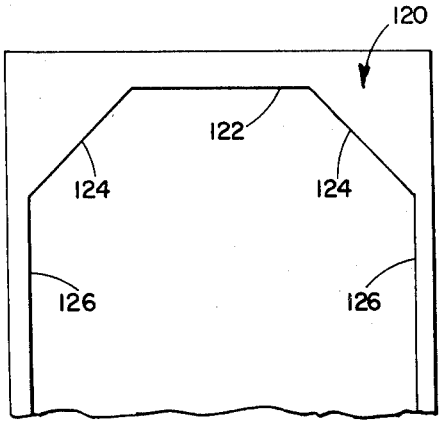
Figure 7:
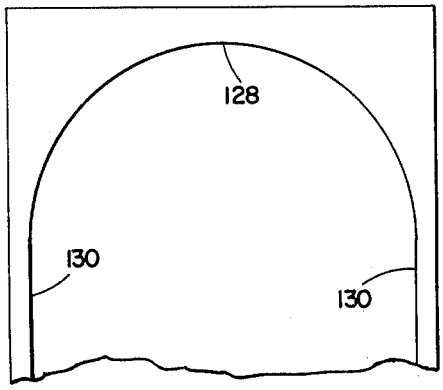
Figure 8:
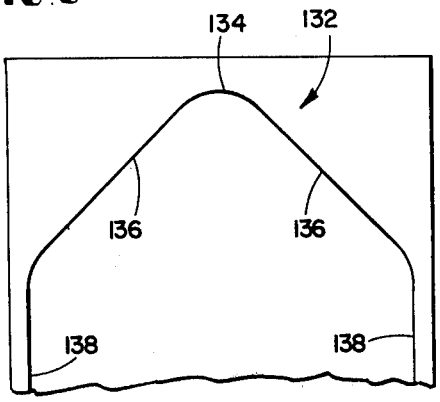
Figure 9:
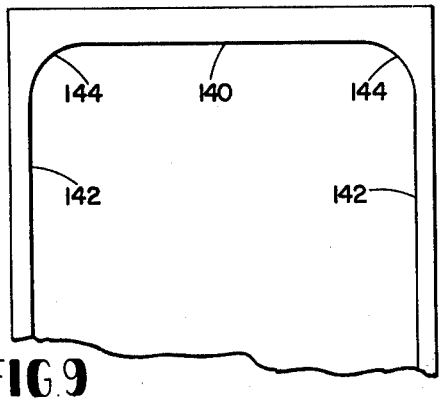
Figure 5:
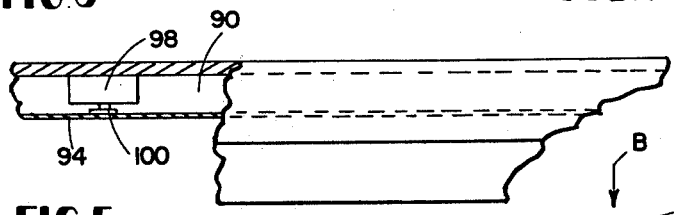
Figure 4:
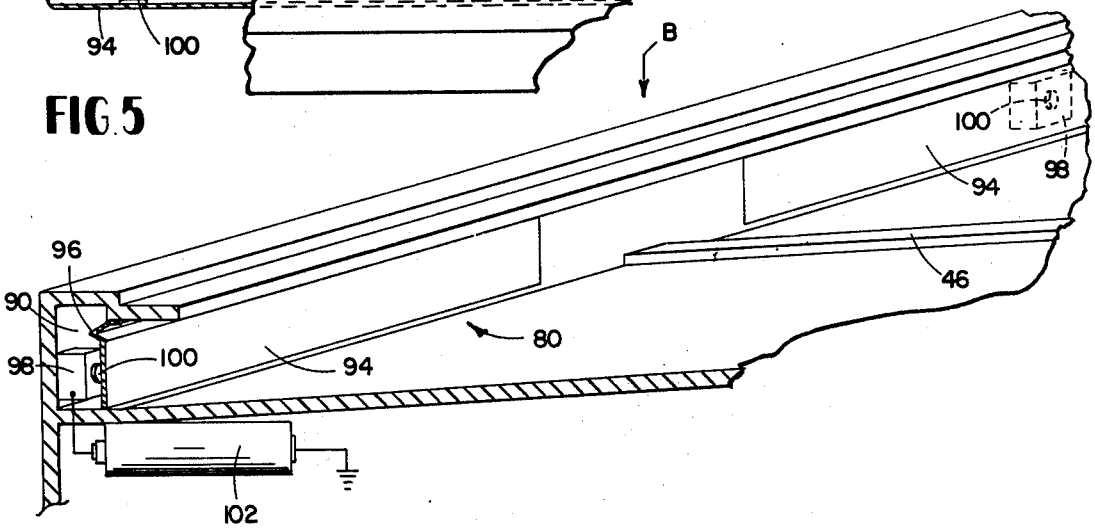
Figure 11:
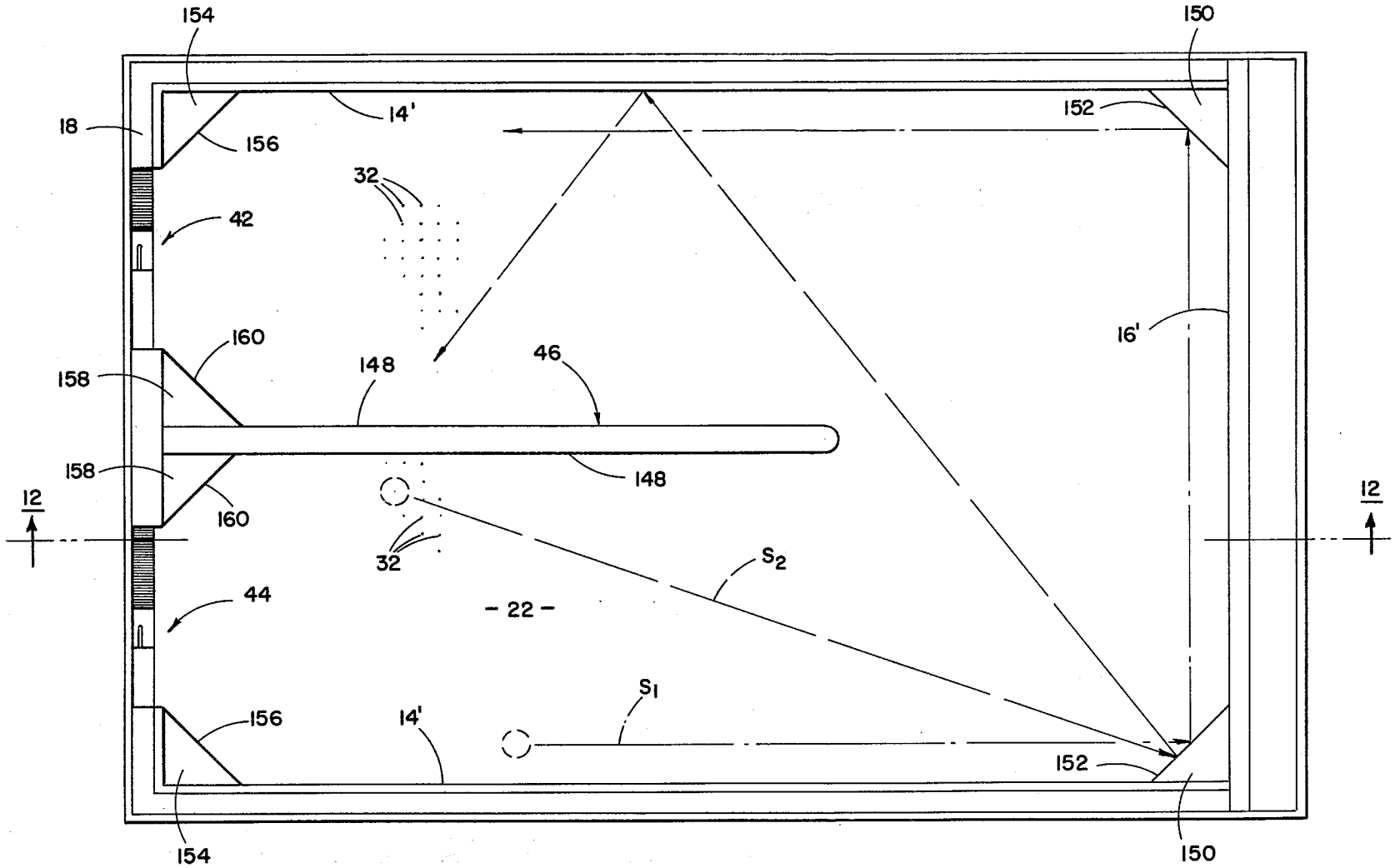
Figure 12:
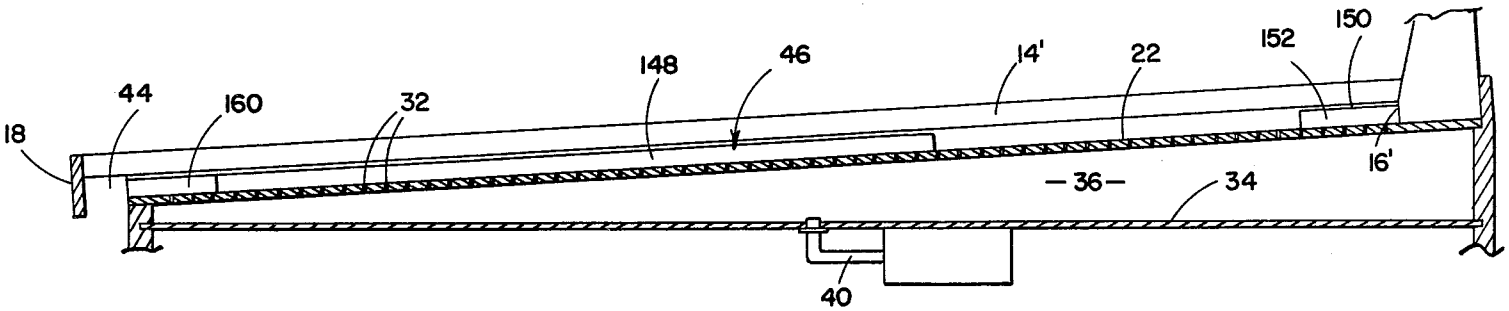
Figure 14:
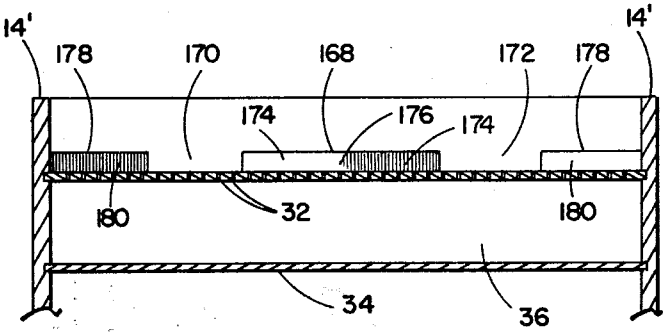
Figure 13:
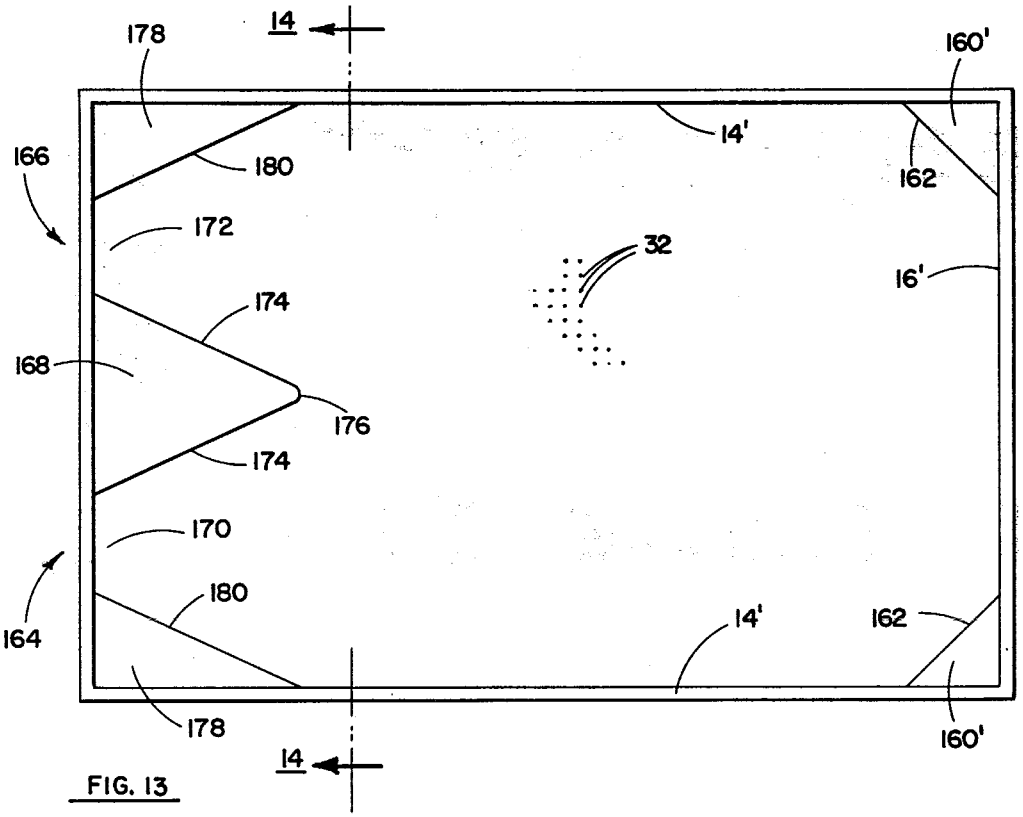

Having thus described the invention in general terms, reference will now be made to the accompanying drawings in which:

FIG. 1 is a top plan view of an air table game constructed in accordance with and embodying the present invention;

FIG. 2 is a side elevational view of the air table game of the present invention, partially shown in section;

FIG. 3 is an enlarged fragmentary vertical sectional view taken along line 3—3 of FIG. 1, and showing the goal mechanism forming part of the air table game of the present invention;

FIG. 4 is a fragmentary is a fragmentary perspective view, partially shown in section and showing a modified form of goal mechanism which may be used in the air table game of the present invention;

FIG. 5 is a fragmentary top plan view, partially shown in section of the embodiment of the air table game of FIG. 4;

FIG. 6 is a fragmentary top plan view showing a modified form of rebound front wall and side walls, and somewhat in a trapezoidal shape, which may be used in the construction of the air table game of the present invention;

FIG. 7 is a fragmentary top plan view, similar to FIG. 6, and showing another modified form of rebound front wall which is somewhat arcuate in shape, and which may be used in the air table game of the present invention;

FIG. 8 is a fragmentary top plan view, similar to FIG. 6, and showing a further modified form of rebound front wall somewhat V-shaped in form and merging into the side walls, and which may be used in the air table game of the present invention;

FIG. 9 is a fragmentary top plan view, somewhat similar to FIGS. 6–8 and showing still another form of rebound front wall which is connected to perpendicularly located sidewalls through arcuate corner margins;

FIG. 10 is a schematic view of an electrical circuit used in the air table game of the present invention;

FIG. 11 is a top plan view of another form of air table game construction in accordance with and embodying the present invention;

FIG. 12 is a fragmentary vertical sectional view taken generally along line 12—12 of FIG. 11;

FIG. 13 is a top plan view of a further form of an air table game construction in accordance with and embodying the present invention; and FIG. 14 is a fragmentary vertical sectional view taken generally along line 14—14 of FIG. 13.

DETAILED DESCRIPTION

Referring now in more detail, and by reference characters the the drawings, which illustrate several embodiments of the present invention, A designates an air table handball game constructed in accordance with and embodying the present invention and which is uniquely designed to create the movement of a playing piece P in a manner somewhat simulated to the movement of a handball in a conventional handball game.

The air table game A is comprised of a main frame 10 carried by a base frame section 12, the latter being comprised of a plurality of rectangularly located legs. In many cases the base frame 12 could be eliminated so that the game may be disposed on a table or like structure. The main frame 10 includes a pair of opposed longitudinally extending side walls 14 and a front wall 16 at the forward end of the frame 10, and a rear wall 18.

A playing plate 20 is retained on the frame 10 and is provided with an upwardly presented playing surface 22 as illustrated in FIGS. 1 and 2. An interior rail 24 extends around the front wall 16 and the two side walls 14 and is located on the plate 20 to provide side wall rebound surfaces 14' and a front wall rebound surface 16'. The rearward end of the frame 10 constitutes a player's end or so-called "playing end" which is divided into two player sections as hereinafter described in more detail. As shown by FIG. 1, the illustrated playing surface 22 is rectangular, and extends lengthwise from the playing end toward a forward rebound end. Since the playing end is divided in half to provide the two player sections, and since the overall length is greater than the width, each player section of the illustrated playing surface has a width which is less than half the length of the surface. Even if a square playing surface were provided, the width of each player section would not exceed one half the playing surface length. In the design of the present invention, it can be observed that the side wall rebound surface 14' and the front wall rebound surface 16' are sufficiently high in order to accommodate movement of the playing piece P and to provide rebound movement of the playing piece P which is somewhat representative of the movement of a handball in a normal handball game.

The upper surface of the rail 24 at the player end of the apparatus A may also be provided with scorekeeping elements if desired (not shown) in which opponent players of the game may keep the score generated by such players, or otherwise the score of the other of the opponent players. These score keeping elements may adopt the form of a series of thumb-wheel rotatable elements carrying numbers on selected sections of the peripheral surfaces thereof which are designed to indicate the score obtained by each of the opponent players.

The playing plate 20 is provided with a plurality of air escapement apertures 32 throughout the surface thereof. Located beneath the plate 20 is a metal or similar form of structural housing 34 which is secured to the plate 20 along its periphery thereof, or at least the major portion thereof, to thereby create an air plenum chamber 36 therebetween. Air is forced into the air plenum chamber 36 by means of a pump 38 which is mounted within the interior of the frame 10, in the manner as shown in FIG. 1 of the drawings, and this air under pressure is introduced into the air plenum chamber 36 by means of a duct 40. The air under pressure which is generated in the air plenum chamber 36 escapes through the apertures 32 and thereby forms an air cushion on the upper surface of the plate 20 in order to thereby form a playing surface in which the playing piece P is supported by the air cushion.

The rearward end of the frame 10 represents the player end as aforesaid, and which is divided into a pair of opposed player goal areas 42 and 44, as more fully illustrated in FIG. 1 of the drawings. In this case, it can be observed that an upstanding dividing arm 46 separates the goal areas 42 and 44 of each of the opponent players. The dividing arm 46 is relatively narrow and is provided with a rounded end 48 to also provide a playing piece rearward surface although the end 48 could be pointed or adopt any other shape. In like manner, a goal area defining line or mark 48' could also be imprinted on the playing surface 22 and extend transversely across the playing surface 22 in the region of the divider arm 46 to define the forwardmost boundaries of the goal areas 42 and 44. Nevertheless, it can be observed that the goal areas 42 and 44 are loated on opposite transverse sides of, but located at the player end of, the air table game A of the present invention.

It can be observed that the divider arm 46 extends generally centrally of the playing surface 22 and projects toward a front rebound surface hereinafter described. The length of the illustrated divider arm 46 is such that a player cannot propel a playing piece P from his goal area toward a side rebound surface without first contacting the front rebound surface. Thus, the illustrated divider arm 46 has a dimension sufficient to intersect an imaginary line drawn from a point furthest on one side of one player goal area to a point furthest to the opposite side of the front rebound surface on the playing surface.

Each of the goal areas 42 and 44 may be provided, in one embodiment of the present invention, with a goal detecting means 51 in the form of a somewhat V-shaped recess 52 which communicates with the playing surface 22 so that the playing piece P may be introduced into the recesses 52 when it passes into the goal areas 42 or 44. The interior rail 24 is discontinuous along the rear wall 18, having openings therein as shown in FIGS. 1 and 3, the playing piece thereby gaining access to the goal detecting means 51 through the opening in the interior rail 24. The rear wall 18 is not discontinuous (FIG. 1) so that a playing piece P may strike the portion of the rear wall 18 which is rearwardly of the opening in the interior rail 24. In this case, only one goal detecting means 51 is more fully described and illustrated in FIG. 3, although the other is substantially identical in construction and operation. These goal detecting means are designed to detect the presence of a playing piece and thereby provide visual indication of a goal and hence a score in a manner to be hereafter described in more detail. Notwithstanding, it could be observed that the goal detecting means 51, including the recesses 52, could be eliminated whereby the goal ends are defined by lines (not shown) imprinted on the playing surface 22 of the playing plate 20. Nevertheless, it has been found that the forms of goal detecting means employed herein are highly satisfactory and effective.

The somewhat V-shaped recess 52 of the goal detecting means 51 comprises a pair of opposed downwardly and inwardly angled wals 54 which open into a chute 56, the latter being sufficiently large to accommodate the playing piece P. The chute 56, in turn, leads into a trough 58 on the underside of the main frame 10 in the manner as illustrated in FIG. 1 of the drawings. If desired the trough 58 could be easily incorporated in the main frame 10. The rail 24 could also be provided with tapered rear wall sections which lead directly into the recesses 52. An upstanding flange 60 at the outer end of the trough 58 prevents the playing piece P from being propelled outwardly therefrom. In addition, an aperture 62 formed at the flange 60 permits removal of the playing piece P so that the game can be reinitiated by placing the playing pieces P on the playing surface 22 of the playing plate 20.

A limit switch 64 is mounted on one of the walls 54 and is actuated by a leaf element, or so-called "contact element" 66 which extends partially over the opening leading into the chute 56. In this way, when a playing piece passes into the chute 56 it will shift the element 66 and close a circuit (hereinafter described) through the switch 64.

Carried by the frame 10 at its forward end, as illustrated in FIG. 1 is an upstanding housing 68 which has a rearwardly presented face plate 70, that is a face plate which is presented toward the player end of the game. The face plate is provided with two sets of illuminated elements 72 and 74, one to depict the score of each opponent player. The number of illuminatable elements in each set is sufficient to depict a score achievable in handball. These illuminatable elements may adopt the form of conventional light bulbs, light emitting diode, or the like. These sets of elements 72 and 74 are connected to the switches 64 in each of the goal detecting means as aforesaid. However, it can be observed that any form of electrically energized or even mechanically actuable score depicting element could be used in this construction.

FIGS. 4 and 5 illustrate a modified form of air table handball game B with essentially a modified form of score detecting means 80 which is construction in accordance with and embodies the present invention. In most other aspects the construction and operation of game B is essentially similar to the game A. The game B is similarly provided with a playing plate corresponding to the playing plate 20 and having an upper playing surface. In addition, the frame of the game B is provided with an upstanding back wall and an inwardly located intermediate wall. A top plate extends beyond the intermediate wall for reasons which will presently more fully appear.

A pair of score detecting means 80 are provided at the player end of the apparatus B and each one of the score detecting means 80 is located on opposite sides of the player end of the apparatus B. These score detecting means 80 are more fully illustrated in FIGS. 4 and 5 of the drawings and each comprises an elongated aperture 90 formed within the intermediate wall on the player end sections. A relatively rigid plate 94 forming a goal defining member is disposed over the aperture 90, and is hingedly connected to the upper margin of the intermediate wall defining the respective apertures 90 through a flexible hinge connection 96.

Located behind the intermediate wall is a limit switch 98 which is operable by a contact plate 100. In this case, it can be observed that the plate 94 extends substantially across the transverse dimension of the apertures 92 at each of the goal areas. Thus, when the playing piece P contacts the plate 94 at each of the goal areas disposed across the apertures 92, the playing piece will thereupon force the plate 94 into contact with the contact plate 100 and thereby actuate the switch 98. In addition, the switch is connected through batteries 102 located on the interior of the frame, as illustrated in FIG. 4 of the drawings, and is electrically connected to score depicting light, such as the lights 72 and 74 illustrated on the interiorly presented wall 70 of the upstanding housing 68. Again, any form of score depicting element, which may be visual or audio in nature, may be substituted in place of the lights 72 and 74. The electrical circuitry which may be used for the score detecting means in both the apparatus A and the apparatus B is more fully illustrated in FIG. 10 of the drawings. It can be observed that each of the banks of the lights 72 or 74 will be connected through the switches 64 and a conventional D.C. battery 104, similar to the battery 102, in somewhat of a series circuit so that the lights 72 and 74 would be energized upon actuation of the switch 64 by contact of the leaf contact arm 66 by the playing piece P. In this case, it is to be observed by reference to FIGS. 1 and 4 of the drawings that a particular score depicting light 72 or 74 is associated with a particular score area 42 or 44, such that the respective lights 72 or 74 will be energized when the playing piece P enters the goal areas and hence actuates the contact switch 64 at the opponent player's score depicting end. Nevertheless, it can be observed that the electical circuitry could be constructed in any manner to energize either one of the lights 72 or 74 upon contact at either of the score depicting ends by the playing piece P.

One terminal of each of the switches 64 and the positive terminal of the battery 104 is connected through conventional stepper switches 106 to the respective light banks 72 and 74. In this respect, the positive terminal of the battery 104 is provided with a reset switch 108 in the line to the stepper switches 106, and this reset switch 108 is provided with a manually operable push-button 110 mounted on the frame 10 at the player end of the game A or the game B. The stepper switches 106 are essentially conventional in construction and would include all of the attendant relays and like auxiliary components and may be constructed in the form of a conventional printed circuit board arrangement.

In addition, a conventional on-off switch (not shown) which may be of the pushbutton type, may be mounted adjacent to the switch push button 110 for energizing and de-energizing the motor of the pump 38.

One of the unique aspects of the present invention is that the player plate 20 is inclined downwardly from the forward end at the front wall 16 to the player end at the end wall 16. In this way, when the playing piece P is projected toward the rebound surface 16' and which may be rebounded off of any of the surfaces 16' the player piece will be shifted downwardly, by the force of gravity to the player end. As indicated previously, the game apparatus of the present invention is uniquely designed to simulate the playing of a handball game by two opponent players located at the player end of the game apparatus and in which the opponent players are located on opposite sides of the player end of this game apparatus.

Moreover, and as indicated previously, the opponent players are located at this player end of the game apparatus and are located so that they are capable of contacting the playing piece P in order to shift the playing piece P into the opponent's score area 42 or 44. For this purpose, each opponent player is provided with a striker member 112 and each such striker member 112 is provided with a circular disc 114 which engages the playing piece P and an upstanding handle 116 connected to the disc 114 for manipulating the disc 114 and thereby engage the playing piece P. In this respect, it can also be observed that the game apparatus of the present invention permits playing of a handball game with the playing piece P being moved on an air cushion.

Nevertheless, the rules of a conventional handball game have been slightly altered to conform to the designs of the game apparatus A or B. In this case, one opponent player, which may be located at the goal area 44, will engage his associated striker member 80 and attempt to move the playing piece P, which is representative of a handball, to rebound against the surface 16' or otherwise the rebound surfaces 14' and thereby propel the playing piece P into the opponent's goal area 42, as for example along the phantom lines illustrated in FIG. 1. If the opponent on the left-hand of the frame 10 does move his striker member 112 to engage the playing piece P and move the same into the opponent's goal area 44 located on the right-hand side of the frame 10, the first mentioned player will have achieved a score as for example a single point in a game of handball. If, on the other hand, the opponent player is not capable of blocking the movement of the playing piece P into its own goal area, such as the goal area 44, then the opponent player at the goal 42 will achieve a score.

In accordance with the embodiment of FIG. 3 of the present invention, it can be observed that a score will be depicted when the playing piece P contacts the switch leaf 66 and thereby energizes one or more lights in the banks 72 or 74 associated with that goal area, and in the manner as previously described. In accordance with the embodiment of FIGS. 4 and 5 the score will be depicted when the playing piece P contacts the plate 94 in the manner as previously described. In this connection it can be observed that the top plate extends beyond the intermediate wall by a distance sufficient to prevent the base 114 of the striker elements 112 to inadvertently engage the plate 94.

The main frame 10, as well as many of the other components of the games A and B, are preferably constructed of a number of known plastic materials, such as polyethylene, polyvinylchloride, or any of a number of known vinylidene copolymer products, polystyrene, polybutadiene or the like. Moreover, these components may be formed from these various known plastic materials by any of a number of conventional plastic molding operations including thermo-forming, blow molding, injection molding, etc. Nevertheless, it also should be understood that the frame 10 and the other components could be constructed of various other materials including metals, either as an integral unit or in discrete components which are welded or otherwise secured together. Notwithstanding, other forms of construction materials may also be used in the construction of the frame and other components of the present invention.

A flexible plastic sheet may be secured to the underside of the plate 20 in place of the housing 34 in order to form the plenum chamber 36. The air pump 38 should be able to provide an air pressure of between 1 psi and about 5 psi. Satisfactory results have been achieved for a 2 × 4 foot playing surface by using a ½ – ¾ h.p. motor running at about 20,000 RPM. Nevertheless, it is preferable to run the motor operating the pump 38 at a lower RPM with a larger fan blade in order to reduce noise. In addition, it may be desireable to separate the air pump unit 38 from the chamber 36 through the conduit 40 and in which case the conduit 40 would be preferably a flexible hose. In this case, the apparatus A could be constructed so that it is a small table unit capable of being disposed on the upper surface of a table or similar supporting structure as aforesaid. In like manner, the apparatus A or B could be constructed so that the frame 10 is provided with the base frame 12 in order to support the apparatus on a floor or similar supporting structure. In this latter case, the legs of the base frame 12 could be made to be removable or foldable in order to be able to store the apparatus A or B in a minimum of space.

In the case of the present invention, it can be observed that the front rebound surface 16', as well as the side rebound surfaces 14', form an arrangement which is generally rectangular in shape. However, FIG. 6 illustrates a modified form of the present invention showing a trapezoidally shaped front wall section 120 which has a rebound surface 122 relatively perpendicular to and extending transversely to the plate 20 and is connected by a pair of oblique angularly located end wall rebound surfaces 124 and which connect into longitudinally extending side wall rebound surfaces 126.

FIG. 7 illustrates a further modified form of construction of the apparatus A or the apparatus B in which the front end wall 16 is cylindrically shaped to provide a front rebound surface 128 which merges into the relatively straight side wall rebound surfaces 130.

FIG. 8 illustrates another modified form of embodiment of the present invention in which the front wall 16 is either somewhat triangular in shape, as represented by reference numeral 132, and having a somewhat arcuate front rebound surface 134; this surface 134 merges into rearwardly and outwardly angulated end wall rebound surfaces 136 in order to form this somewhat triangularly shaped section in which the playing piece P may rebound against the relatively short front wall surface 134 and the angulated end wall rebound surfaces 136 as well as the relatively straight side wall rebound surfaces 138.

FIG. 9 illustrates a further modified form of embodiment of the present invention in which an inwardly presented front wall rebound surface 140 is relatively straight and transverse to the playing plate 20, with side wall inwardly presented rebound surfaces 142 which are also relatively straight, but which are connected to the surface 140 by arcuate corner margins 142.

In each case and in each of the embodiments of the invention as illustrated in FIGS. 6–9 of the drawings, it can be observed that the rebound wall surfaces comprising the forwardly presented end wall rebound surfaces and the side wall rebound surfaces are uniquely designed so that they create movement of the playing piece P in a manner so that it is somewhat representative of the movement of a handball in a normal handball game. While other forms of rebound surface configurations could be constructed at the forward end of the table in accordance with the present invention, it has been found that this form of front end rebound surface, as illustrated in FIG. 1, and with the alternative embodiments, as illustrated in FIGS. 6–9 of the drawings, represents the preferred embodiments of apparatus forward and rebound wall configurations.

The table configuration shown in FIGS. 11 and 12 has been found to provide a highly playable, fast-moving game. The play piece tends to move in paths and in a manner such that it can be readily struck by the players and the play action can progress rapidly and without significant interruptions. The inclined air cushion insures that the play piece will not stop at a position not readily accessible to one of the players, and the various rebound surfaces tend to keep the play piece in intermediate, and therefore more accessible, areas of the playing surface. In particular, angled corner bumper sections provide angled rebound surfaces which keep the play piece from lodging in corner areas, and further rebound the play piece out into open areas of the playing surface away from the rebound walls or surfaces. The divider section causes the players to aim the play piece so it will avoid hitting the divider, which thereby tends to direct the path of the play piece against the front rebound wall initially, rather than at a greater angle so that it will first engage the opposite side wall. In this way, the usual travel of the play piece tends to be more controlled or directed, and the action faster. In other words, the configuration of the table with the center divider has a tendency to provide more controlled or defined movement of the play piece along more predictable and direct paths between goal areas; this, in turn, tends to produce long rallies with the play piece being hit back and forth a greater number of times before a goal is scored than with prior art air table games having goals at opposite ends of the table.

The air table shown in FIGS. 11 and 12 is generally similar to the table of FIG. 1, having a playing surface 22, side and front rebound surfaces 14' and 16' respectively, a divider arm 46, and a pair of side-by-side goal areas 42 and 44. The divider arm 46 forms a rebound surface 148 at each side thereof. At each corner where the side and front rebound surfaces 14' and 16' meet, an angled front bumper section 150 is provided. Each front bumper section 150 provides an angled front corner rebound surface 152 which is shown extending across the corner at about a 45° angle from the side rebound surface. At each corner where a side rebound surface 14' meets the rear wall 18, an angled rear bumper section 154 is provided. Each rear bumper section 154 provides an angled rear corner rebound surface 156 which is shown extending across the corner at about a 45° angle from the side rebound surface. In addition, also at the rear end of the table, at each corner formed between the rear wall 18 and the divider arm 46, an angled rear center bumper section 158 is provided. Each angled rear center bumper section 158 provides an angled rear center rebound surface 160 that extends across the corner at about a 45° angle from the rebound surface 148 of the divider arm 46.

As noted above, the corner of angled rebound surfaces tend to direct the playing piece into the open areas of the playing surface away from the rebound surfaces to facilitate faster and generally continuous play action. Further, the angled rebound surfaces at the front end of the table can be used to perform angle shots such as illustrated as examples in broken lines in FIG. 11. Such angle shots can be very effective where the playing piece encounters very little friction from the playing surface, and can therefore afford to travel a long distance and to rebound a number of times before reaching the opponent's goal.

In this connection, the provision of 45° angles at the front rebound corners permit the playing piece to follow those paths as shown in broken lines in FIG. 11, for example. One play piece trajectory is illustrated by the broken line $S_1$ in FIG. 11 where the play piece follows a path from one player end generally parallel to a first side wall, then rebounds and continues in a path generally parallel to the front rebound end, and then rebounds and continues in a path generally parallel to the second side wall. Continuing along the path shown, the play piece would bounce off of the corner section 154 and move transversely across the front of the goal area 42; in so doing, it could engage the striker and be deflected into the goal. If desired, the size and/or angle of the corner bumpers could be changed to permit a more direct rebound shot into the goal.

While 45° angles are illustrated and offer certain desirable features or advantages, other selected angles may be utilized.

In the event that a playing piece moves toward the region of the divider 46, it may be difficult for the player to engage the playing piece and direct the same to the front rebound wall 16' at an angle sufficient to move the playing piece into the opponent player's area. Consequently, the player may use the rebound bumper section 150 to move the playing piece into the opponent player's court. Thus, the playing piece may move in a path designated as $S_2$ in FIG. 11 of the drawings. In this way, the game of the present invention more closely simulates the strategy and various play maneuvers normally found in an actual handball game.

In accordance with the above, it can be observed that the illustrated constructions, particularly as shown in FIGS. 11 and 12, are uniquely designed so that the inclined air cushion surface combines with the various rebound surfaces to create the desired fast and generally continuous play action movement of the playing piece which is representative of a handball in a normal handball playing court.

FIGS. 13 and 14 illustrate another modified form of air table game which is constructed in a manner similar to and operates in a manner similar to the previously described air table games. This air table game of FIGS. 13 and 14 provides for a somewhat different player area construction which affects the potential movement of a playing piece as it approaches a goal area.

In this case, the game apparatus comprises an inclined playing plate 20 having an upwardly presented playing surface 22 along with the side wall rebound surfaces 14' and a front wall rebound surface 16', in the same manner as the apparatus A of FIG. 1. Front bumper sections 160', similar to the previously described bumper sections 150, are provided in the corners where the side and front rebound surfaces 14' and 16', respectively, meet and each bumper section provides an inwardly facing front corner rebound surface 162.

The player end of the table is divided into a pair of side-by-side player sections 164 and 166 by an upstanding divider 168 projecting from the player end toward the front rebound surface 16' and located intermediate the two side rebound surfaces 14'. Moreover, each of the two player areas 164 and 166 are provided, respectively, with goals 170 and 172 in the same manner as in the previously described game apparatus.

The divider 168 in this case is relatively short in the longitudinal dimension, compared to the upstanding divider 46 in the apparatus A. The divider 168 has a somewhat triangular shape with a pair of rearwardly diverging walls 174, each leading toward an individual goal 170 and 172, and which are connected by a relatively small arcuate section 176. In this case, the walls 174 and the arcuate section 176 also serve to provide rebound surfaces for the playing piece. A pair of rear corner bumper pads 178 are located at the corners between the side rebound surfaces 14' and the player end, as illustrated in FIG. 13, and each of these bumper pads provide inwardly presented angled rear corner rebound surfaces 180.

By further reference to FIG. 13, it can be observed that the corner rebound surfaces also incline inwardly toward the goals 170 and 172 and at substantially the same angle as the rebound surfaces 174. In addition, it can be observed that the corner rebound pads 178 project toward the front rebound surface 16' and terminate approximately in the same transverse plane as the relatively small arcuate section 176. Moreover, by reference to FIG. 14, it can be observed that the divider 168 and the corner rebound pads 178 have substantially the same height, which is at least sufficient to prevent the playing piece from jumping over the divider 168 or the rebound pads 178 upon contact therewith and thereby confine movement of the playing piece.

It can be observed that this construction enables the playing of a simulated handball game with fast action in a simulated handball court of minimum space. Due to the fact that a playing piece moving toward a goal area can be directed toward the goal area by the inclined nature of the rebound surfaces 174 and 180, the opposing player is required to move quickly and exercise a reasonable skill to repel the playing piece from his goal area. In many cases, the play piece may first contact one of the rebound surfaces 174 or 180 and then rebound back and forth between these two surfaces, but at least toward the goal areas 170 or 172, somewhat in the form of a "funnel" effect. In addition, the various rebound surfaces prevent the playing piece from being lodged in any corner area and will always keep the playing piece in movement thereby lending to increased speed of play with longer rallies of the playing piece being hit back and forth a greater number of times before a goal is attained.

Upon achieving movement of the playing piece P into the opponent's goal area, the opponent player will thereby score a point. Moreover, the game apparatus of the present invention is provided with a unique goal area and the goal detecting means is illustrated in FIG. 3 of the drawings. While these two forms of goal detecting means are preferred, it sould be recognized that other forms of goal detecting means could also be provided in accordance with the present invention.

Thus, there has been illustrated and described a unique and novel air table game apparatus which has been constructed in accordance with and embodies the present invention and which therefore fulfills all of the objects and advantages sought therefor. It should be understood, however, that many changes, modifications, variations, and other uses and applications could become apparent to those skilled in the art after considering this disclosure and the accompanying drawings thereof. Therfore, any and all such changes, modifications, variations, and other uses and applications are deemed to be covered by the present invention which is limited only by the following claims.

Having thus described our invention, what we desire to claim and secure by letters patent is:

1. A game apparatus capable of generating an air cushion for supporting a movable playing piece thereon, and for affording fast and generally continuous play action movement of the playing piece, said apparatus comprising:

a. a member having a generally flat upper surface defining a playing surface having a front rebound end and a rear player end, said surface being inclined downwardly from said rebound end toward said player end, b. means defining a plurality of apertures through said playing surface, c. means located beneath said member and secured thereto to form an air chamber in communication with said apertures, d. means operatively associated with and connected to said apparatus for providing air under pressure into said air chamber so that air is emitted through said apertures to provide an air cushion above said playing surface to support a play piece for movement across the playing surface, e. a pair of opposed side walls extending upwardly from said playing surface, each having a forward end adjacent said front rebound end, a rearward end adjacent said rear player end, and having inwardly presented side rebound surfaces, f. a front wall extending upwardly from said playing surface and having an inwardly presented front rebound surface, g. means including said inward side and front rebound surfaces extending around the periphery of said playing surface except for at least a portion of said rear player end, h. an elongated upstanding divider means disposed generally centrally of said playing surface and extending from said rear player end toward said forward rebound end a portion of the distance between said front and rear ends of the playing surface so as to divide the player end of said playing surface into a pair of transversely spaced player goal areas, said divider means defining a pair of upstanding outwardly presented side rebound surfaces each spaced opposite the inwardly presented side rebound surface of one of the side walls, i. corner bumper means disposed in operative relation to said playing surface and providing a corner rebound surface at the forward end of each of said inward side rebound surfaces and at the rearward end of each of at least two of the side rebound surfaces, one in each of said player goal areas, said rebound corner surfaces extending at an obtuse angle to the side wall adjacent thereto.

j. a play piece slidable over the playing surface, and k. a pair of striker members for use by the players of the game to alternately stroke the play piece to propel it over the playing surface and against the rebound surfaces toward the goal area of the other player.

2. The game apparatus of claim 1 wherein said corner bumper means define angle corner rebound surfaces at the rearward ends of all four of said side rebound surfaces.

3. The game apparatus of claim 2 further characterized in that said divider means presents a pair of inclined side rebound surfaces, and each one of said inclined side rebound surfaces being inclined toward an individual one of the player goal areas and the corner bumper means at the rearward ends of said side rebound surfaces also being inclined inwardly toward each one of said player goal areas.

4. The game apparatus of claim 3 further characterized in that said rebound surfaces on said divider means and the rebound surfaces on said rear corner bumper means incline toward the goal areas at approximately the same angle.

5. The game apparatus of claim 1 further characterized in that said front wall and said side walls form part of a rectangularly shaped periphery around said playing surface.

6. A game apparatus capable of generating an air cushion for supporting a movable playing piece thereon, and for affording fast and generally continuous play action movement of the playing piece, said apparatus comprising:

a. a member having a generally flat upper surface defining a playing surface having a front rebound end and a rear player end, said surface being inclined downwardly from said rebound end toward said player end, b. means defining a plurality of apertures through said playing surface, c. means located beneath said member and secured thereto to form an air chamber in communication with said apertures, d. means operatively associated with and connected to said apparatus for providing air under pressure into said air chamber so that air is emitted through said apertures to provide an air cushion above said playing surface to support a play piece for movement across the playing surface, e. a pair of opposed side walls extending upwardly from said playing surface, each having a forward end adjacent said front rebound end, a rearward end adjacent said rear player end, and having inwardly presented side rebound surfaces, f. a front wall extending upwardly from said playing surface and having an inwardly presented front rebound surface, g. means including said inward side and front rebound surfaces extending around the periphery of said playing surface except for at least a portion of said rear player end, h. an elongated upstanding divider means disposed generally centrally of said playing surface and extending from said rear plays end toward said forward rebound end a portion of the distance between said front and rear ends of the playing surface so as to divide the player end of said playing surface into a pair of transversely spaced player goal areas, said divider means defining a pair of upstanding ouwardly presented side rebound surfaces each spaced opposite the inwardly presented side rebound surface of one of the side walls, and i. corner bumper means disposed in operative relation to said playing surface and providing a corner rebound surface at the forward end of each of said inward side rebound surfaces and at the rearward end of each of all four of the side rebound surfaces, said corner rebound surfaces extending at an obtuse angle to the side rebound surface adjacent thereto.

7. The game apparatus of claim 6 further characterized in that each one of the pair of inwardly presented side rebound surfaces, and each one of the pair of outwardly presented side rebound surfaces being inclined toward an individual one of the player goal areas at approximately the same angle.

8. The game apparatus of claim 6 further characterized in that said front wall and said side walls form part of a rectangularly shaped periphery around said playing surface.

9. A game apparatus capable of generating an air cushion for supporting a movable playing piece thereon, and for affording fast and generally continuous play action movement of the playing piece, said apparatus comprising:

a. a member having a generally flat upper surface defining a playing surface having a front rebound end and a rear player end, said surface being inclined downwardly from said rebound end toward said player end, b. means defining a plurality of apertures through said playing surface, c. means located beneath said member and secured thereto to form an air chamber in communication with said apertures, d. means operatively associated with and connected to said apparatus for providing air under pressure into said air chamber so that air is emitted through said apertures to provide an air cushion above said playing surface to support a play piece for movement across the playing surface, e. a pair of opposed side walls extending upwardly from said playing surface each having a forward end adjacent said front rebound end, a rear end adjacent said rear player end, and having inwardly presented side rebound surfaces, f. a front wall extending upwardly from said playing surface and having an inwardly presented front rebound surface, g. means including said inward side and front rebound surfaces extending around the periphery of said playing surface except for at least a portion of said rear player end, h. an elongated upstanding divider means disposed generally centrally of said playing surface and extending from said rear player end toward said forward rebound end a portion of the distance between said front and rear ends of the playing surface so as to divide the player end of said playing surface into a pair of transversely spaced player goal areas, said divider means defining a pair of upstanding outwardly presented side rebound surfaces each spaced opposite the inwardly presented side rebound surface of one of the side walls, i. corner bumper means disposed in operative relation to said playing surface and providing a corner rebound surface at the rearward end of each of at least two of the side rebound surfaces, one in each of said player goal areas, said corner rebound surfaces extending at an obtuse angle to the side rebound surface adjacent thereto, j. a play piece slidable over the playing surface, and k. a pair of striker members for use by the players of the game to alternately strike the play piece to propel it over the playing surface and against the rebound surfaces toward the goal area of the other player.

10. The game apparatus of claim 9 further characterized in that said front wall is arcuately shaped.

* * * * *

UNITED STATES PATENT OFFICE

CERTIFICATE OF CORRECTION

PATENT NO. : 4,017,078

DATED : April 12, 1977

INVENTOR(S) : Adolph E. Goldfarb, et al

It is certified that error appears in the above-identified patent and that said Letters Patent are hereby corrected as shown below:

In the abstract, at
Lines 26, 27 and 28, delete "piece and to prevent it from coming to rest and thereby stopping the action play".

In Claim 6, column 15, line 37, change "plays" to -- player --.
In Claim 6, column 15, line 43, change "ouwardly" to -- outwardly --

Signed and Sealed this

*Twenty-seventh* Day of *September 1977*

[SEAL]

*Attest:*

RUTH C. MASON
*Attesting Officer*

LUTRELLE F. PARKER
*Acting Commissioner of Patents and Trademarks*